US006673306B2

(12) United States Patent
Abrino et al.

(10) Patent No.: US 6,673,306 B2
(45) Date of Patent: Jan. 6, 2004

(54) REFRACTORY LINING FOR METALLURGICAL VESSEL

(75) Inventors: Donald E. Abrino, Curwensville, PA (US); John Crooks, Robesonia, PA (US); Ronald Barrett, Curwensville, PA (US); Shyam Miglani, State College, PA (US)

(73) Assignee: North American Refractories Co., Moon Township, PA (US)

( * ) Notice: Subject to any disclaimer, the term of this patent is extended or adjusted under 35 U.S.C. 154(b) by 0 days.

(21) Appl. No.: 09/834,463

(22) Filed: Apr. 13, 2001

(65) Prior Publication Data

US 2002/0153645 A1 Oct. 24, 2002

(51) Int. Cl.[7] ..... C21B 3/00
(52) U.S. Cl. ..... 266/275; 266/280
(58) Field of Search ..... 266/44, 45, 236, 266/275, 280, 283, 286

(56) References Cited

U.S. PATENT DOCUMENTS

| | | | | |
|---|---|---|---|---|
| 2,914,413 A | * | 11/1959 | Mercer | 106/84 |
| 3,503,598 A | | 3/1970 | Babel et al. | 266/39 |
| 3,646,722 A | | 3/1972 | Salmi, III | 52/745 |
| 3,655,356 A | | 4/1972 | Javaux | 65/182 R |
| 3,665,870 A | | 5/1972 | Lewicki | 110/1 A |
| 4,177,855 A | * | 12/1979 | Duchateau et al. | 266/275 |
| 4,424,756 A | | 1/1984 | Merkle | 110/332 |
| 4,475,470 A | | 10/1984 | Merkle | 110/332 |
| 4,744,544 A | * | 5/1988 | LaBate et al. | 266/44 |
| 4,989,843 A | | 2/1991 | Dittrich et al. | 266/283 |
| 5,110,096 A | | 5/1992 | Zacharias | 266/227 |
| 5,238,986 A | * | 8/1993 | Montgomery | 524/365 |
| 5,395,096 A | | 3/1995 | Moreira et al. | 266/280 |
| 5,704,184 A | * | 1/1998 | Meloy | 266/283 |
| 5,761,859 A | | 6/1998 | Duda | 52/204 |
| 5,800,775 A | | 9/1998 | Vihnicka et al. | 266/230 |
| 5,879,616 A | | 3/1999 | Erny | 266/45 |
| 5,882,583 A | * | 3/1999 | Erny | 266/283 |
| 6,017,487 A | | 1/2000 | Fish | 266/283 |

FOREIGN PATENT DOCUMENTS

| | | | | |
|---|---|---|---|---|
| GB | 2164281 A | * | 3/1986 | 222/603 |

OTHER PUBLICATIONS

Derwent Document 1995–358956, Nov. 1994.*
Derwent Document 1995–358957, Nov. 1994.*

* cited by examiner

*Primary Examiner*—Scott Kastler
(74) *Attorney, Agent, or Firm*—Mark Kusner; Michael A. Jaffe

(57) ABSTRACT

A lining for a bottom of a metallurgical vessel, comprising an impact pad having a plurality of close-packed, pre-formed, high-temperature, high-density refractory bricks, the pad having an upper impact surface, and a monolithic slab of a high-temperature refractory material encasing the pad, the slab encasing the pad wherein the upper surface of the impact pad is exposed.

6 Claims, 9 Drawing Sheets

REFRACTORY LINING FOR METALLURGICAL VESSEL

FIELD OF THE INVENTION

The present invention relates generally to refractory linings for metallurgical vessels, and more particularly to a lining bottom for such vessels. The invention is particularly applicable for use in ladles used in handling molten steel, and will be described with particular reference thereto. It will, of course, be appreciated that the present invention has application in other types of metallurgical vessels for handling molten metal.

BACKGROUND OF THE INVENTION

The handling of high-temperature liquids, such as molten steel, requires special materials and techniques. Ladles used for handling molten steel are comprised of an outer metallic shell that is lined with a refractory material. The inner surface of the metallic shell is typically lined with one or more layers of a refractory brick that can withstand extremely high temperatures and harsh, abrasive conditions. Such brick eventually wears from repeated use of the ladle, thus requiring its repair or replacement. One mechanism causing wear of the refractory lining is the impact forces exerted on the lining when high temperature liquids are poured into the ladle. These "stream impact" forces tend to significantly increase erosion in certain portions of the bottom lining of the ladle.

In order to balance wear of the refractory lining and steel ladle, it is known to use thicker bricks in the area of steel stream impact. As will be appreciated, the lining of ladles with brick is both time-consuming and labor intensive. Castable refractory materials that can withstand the high temperatures of molten steel are known, but many of these refractory materials quickly wear in the area of steel stream impact. Some castable materials can withstand both high temperatures and have good corrosion properties, but such materials are typically relatively expensive and less cost efficient.

The present invention overcomes these and other problems and provides a refractory assembly for lining the bottom of a metallurgical vessel, such assembly having an impact area comprised of high-density, high-temperature bricks.

SUMMARY OF THE INVENTION

In accordance with the present invention, there is provided a lining for the bottom of a metallurgical vessel comprising an impact pad comprised of a plurality of close-packed, pre-formed refractory bricks. The pad has an upper impact surface. A monolithic slab of a high-temperature refractory material encases the pad. The slab encases the pad such that the upper surface of the impact pad is exposed.

In accordance with another aspect of the present invention, there is provided a bottom lining in a metallurgical vessel that is used for receiving and dispensing a molten metal. The lining is comprised of an impact pad comprised of a plurality of close-packed, pre-formed refractory bricks. The pad has an upper impact surface. A monolithic slab of a high-temperature refractory material encases the pad. The slab encases the pad such that the upper surface of the impact pad is exposed.

In accordance with another aspect of the present invention, there is provided a method of forming a refractory lining for the bottom of a metallurgical vessel, comprising the steps of:

(a) forming an impact pad by assembling a plurality of pre-formed, high-density, high-temperature refractory bricks into a close-packed arrangement, the pad having an upper impact surface;

(b) pouring a high-temperature refractory material into a cavity around the pad; and (c) curing the refractory material to form a monolithic slab encasing the pad with the upper impact surface of the pad exposed.

It is an object of the present invention to provide a refractory lining for the bottom of a metallurgical vessel.

It is another object of the present invention to provide a lining as described above that includes a high-temperature, resistant, high-density impact area on which incoming molten metal may impinge.

It is another object of the present invention to provide a lining as described above wherein a portion of said lining is a cast refractory.

A still further object of the present invention is to provide a lining as described above wherein a major portion of the lining is a cast refractory.

A still further object of the present invention is to provide a lining as described above that may be pre-formed for insertion into a metallurgical vessel.

A still further object of the present invention is to provide a method of forming a lining for the bottom of a metallurgical vessel as described above.

A still further object of the present invention is to decrease ladle down time and the cost associated with the replacement of a lining for a metallurgical vessel.

These and other objects and advantages will become apparent from the following description of a preferred embodiment in the present invention taken together with the accompanying drawings and the appended claims.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof, and wherein.

DETAILED DESCRIPTION OF PREFERRED EMBODIMENTS

Figure 1:
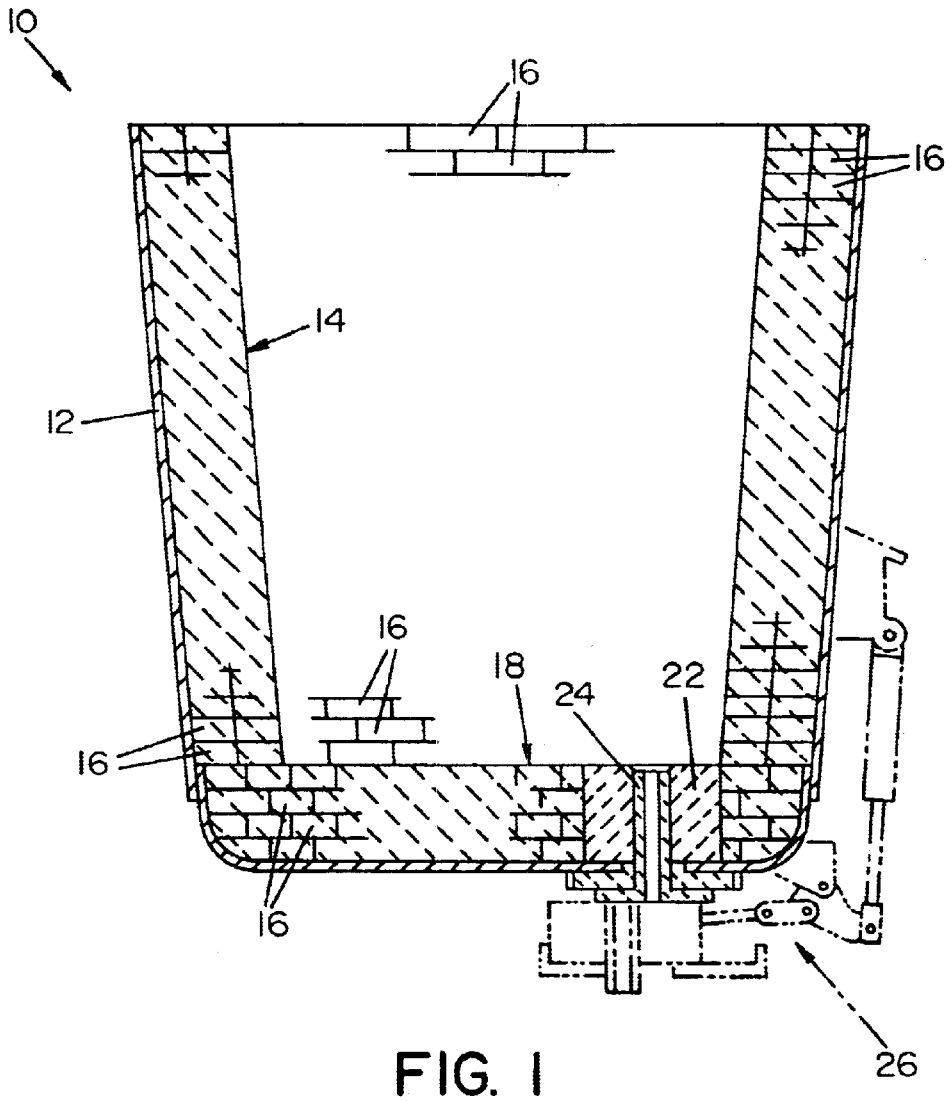
FIG. 1 (PRIOR ART)
FIG. 1 is a side, sectional view of a ladle for handling molten steel showing a conventional interior brick lining.

Referring now to the drawings wherein the showings are for the purpose of illustrating preferred embodiments of the invention only, and not for the purpose of limiting same, the present invention relates generally to a refractory lining for a metallurgical vessel. The invention is particularly applicable to a steel ladle used in handling molten steel, and will be described in particular reference thereto. Although it will be appreciated from a further reading of the specification, that the invention is not limited to a steel ladle, but may find advantageous application for linings used in other types of metallurgical vessels handling molten metal.

FIG. 1 shows a conventional steel ladle 10 having an outer metallic shell 12 and an inner refractory lining 14. Lining 14 is comprised of layers of refractory brick 16. Ladle 10 has a bottom lining 18 comprised of four layers of refractory brick 16. A refractory, nozzle block 22 is disposed in bottom lining 18. Nozzle block 22 includes an upper nozzle 24 that is part of a slide gate assembly 26, shown in phantom. Nozzle block 22 and slide gate assembly 26, in and of themselves, form no part of the present invention, and therefore shall not be described in detail. These components are shown to illustrate the environment of the present invention.

Figure 2:
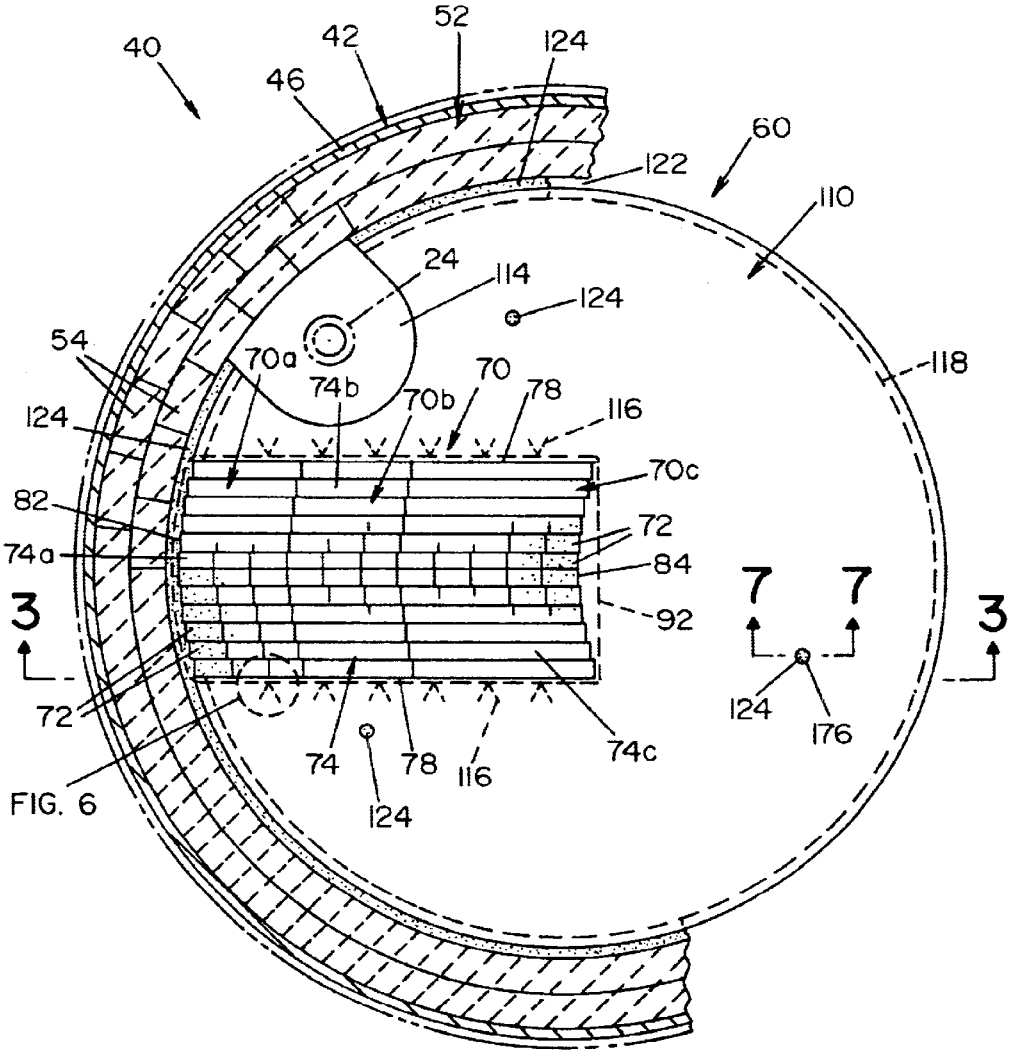
FIG. 2 is a top, plan view of a lining for the bottom of a steel ladle illustrating a preferred embodiment of the present invention.
Figure 3:
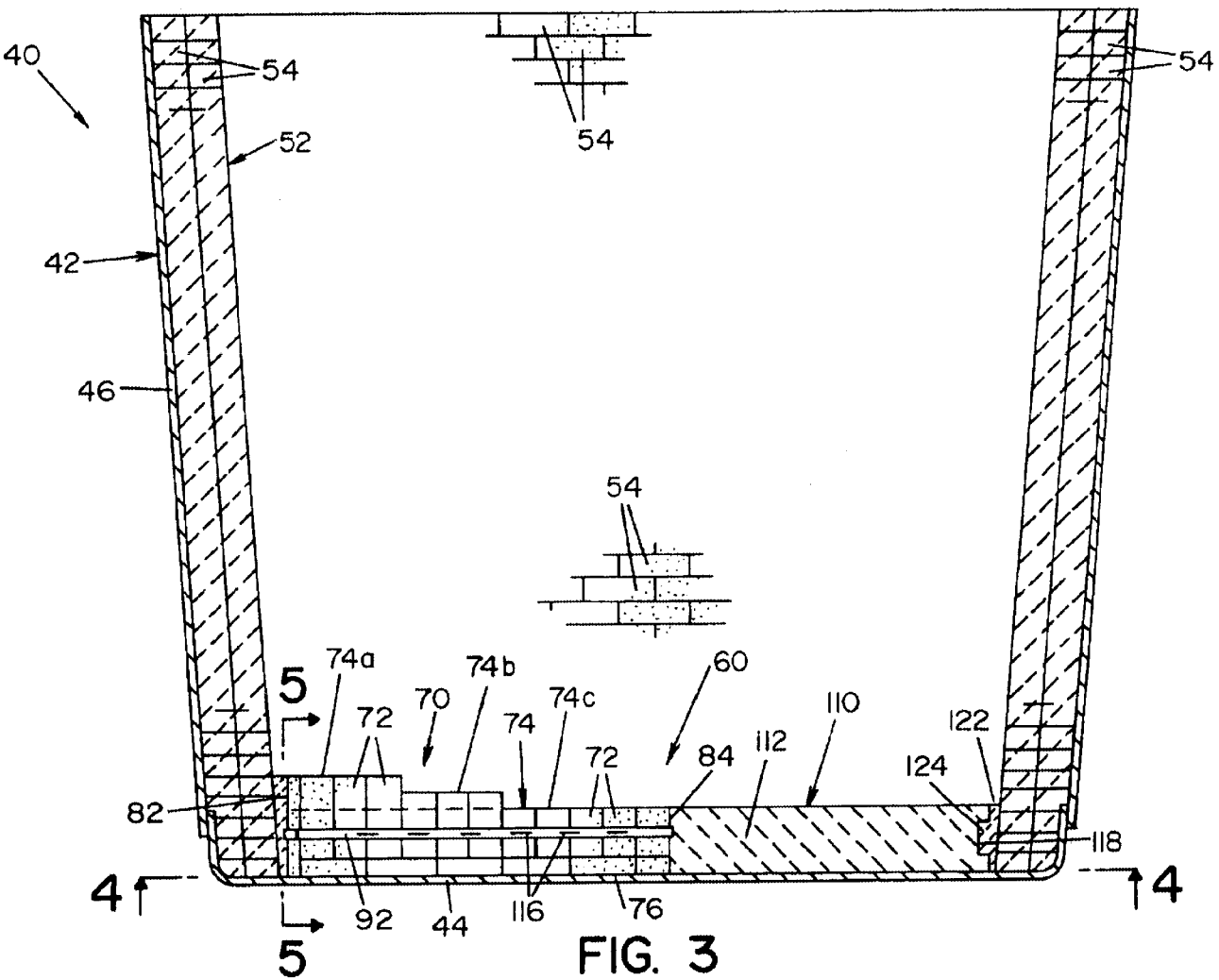
FIG. 3 is a sectional view taken along lines 3—3 of FIG. 2.

Referring now to FIGS. 2–5, a bottom lining 60, illustrating a preferred embodiment of the present invention is shown. Bottom lining 60 is shown disposed within a ladle 40. Ladle 40 has an outer metallic shell 42 comprised of a cup-shaped bottom 44 and a slightly conical side wall 46. A refractory lining 52 comprised of two layers of refractory brick 54 is disposed along the inner surface of side wall 46. In the embodiment shown, refractory lining 52 extends along the entire side of shell 42 from bottom 44 to the open upper end of ladle 40, as best seen in FIG. 3. Bottom lining 60 is adapted to be disposed on bottom 44 of ladle 40 within refractory lining 52, as shown in FIGS. 2–5.

Bottom lining 60 is basically comprised of an impact pad 70 embedded within a monolithic, refractory slab 110. Impact pad 70 is comprised of a plurality of tightly packed high-density and high-temperature refractory bricks 72. As used herein, the term "high density" refers to a refractory brick 72 having an initial density of at least 180 lb/ft$^3$. The term "high temperature" refers to a brick capable of withstanding at least 2,900° F., the approximate melting temperature of steel.

An alumina-magnesia-carbon brick manufactured and sold by North American Refractories Co. under the trade designation COMANCHE FA is particularly applicable in the present invention. However, it will be appreciated from a further reading of the specification, that the present invention is not limited to a specific type of brick or brick composition, and that other refractory bricks having the aforementioned minimum density and temperature characteristics may find advantageous application in practicing the present invention.

Figure 8:
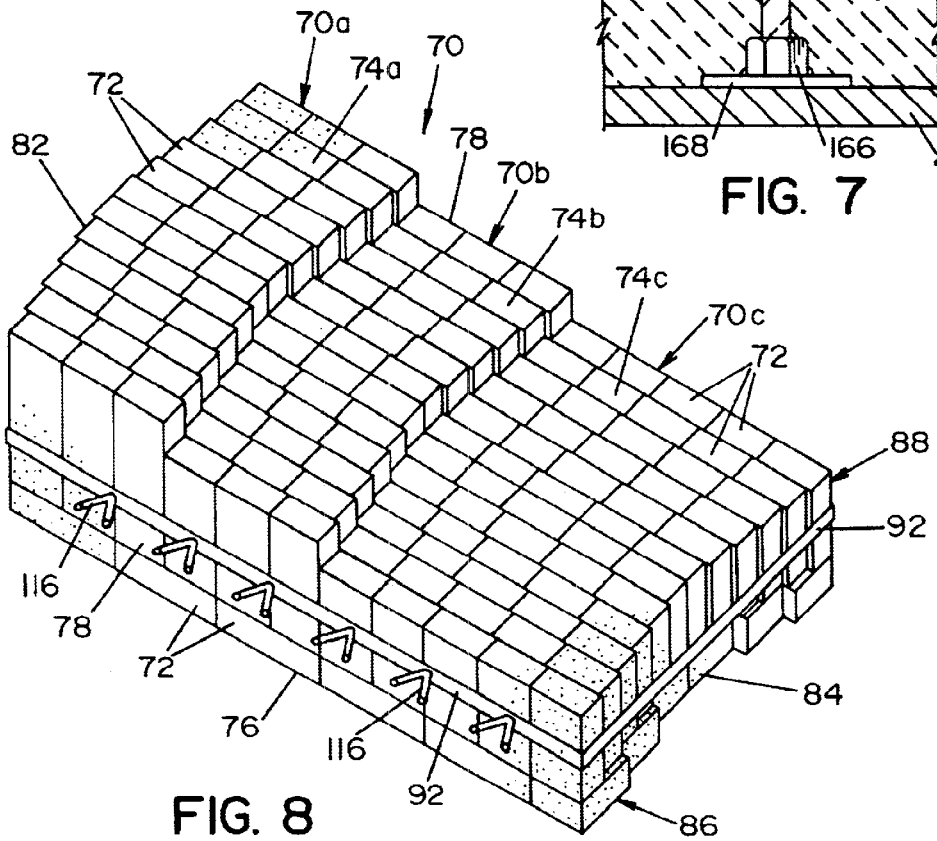
FIG. 8 is a perspective view of a pre-formed impact pad for use in forming a lining of the type shown in FIG. 2, illustrating another embodiment of the present invention.

As best seen in FIG. 8, different sizes of bricks 72 are arranged to form an impact pad 70 having three sections, designated 70*a*, 70*b*, 70*c*, that form a stepped configuration. Impact pad 70 has an upper surface 74 comprised of surfaces 74*a*, 74*b*, 74*c* that correspond respectively to sections 70*a*, 70*b*, 70*c*. Impact pad 70 has a planar bottom surface 76 and planar side surfaces, designated 78. In the embodiment shown, impact pad 70 is comprised of a lower layer 86 of bricks 72 that are arranged side-to-side and end-to-end, wherein the major faces of the bricks form bottom surface 76. A second upper layer 88 is arranged on lower layer 86, formed of bricks 72 of different lengths, that are assembled on end on lower layer 86, to form sections 70*a*, 70*b*, 70*c*. Refractory bricks 72 are arranged to form a convex first end 82 that matches the profile of the inner surface of lining 52 of ladle 40. Since bricks 72 are assembled in close packed fashion, the curvature of first end 82 is carried through impact pad 70 to form a second end 84 that has a generally concave shape, as best seen in FIG. 2.

The shape of impact pad 70, as shown in FIGS. 2–5, is based upon the configuration of ladle 40, and a desire to have a greater wear area in certain regions of ladle 40. In this respect, the shape, configuration of impact pad 70 and its location within ladle 40 may vary depending upon a specific application. Stated another way, an impact pad 70, according to the present invention, may assume other shapes and configurations, and may be disposed in other regions of bottom lining 60, without deviating from the present invention.

Impact pad 70 may be assembled in situ within ladle 40, but in accordance with one aspect of the present invention, impact pad 70 is preferably a preformed structure. As a pre-formed structure, impact pad 70 may be embedded within slab 110 in situ within ladle 40, or may be placed within ladle 40 as an integral part of a unitary bottom lining 60.

In one embodiment of impact pad 70, bricks 72 may be pre-assembled and maintained in a desired shape by metallic bands that extend around bricks 72. Such bands would apply an inward force to maintain the structural integrity of impact pad 70. As best seen in FIG. 8, a band 92 extends around upper layer 88 of impact pad 70.

As will be appreciated, the ability to use bands alone to maintain the structural stability of an impact pad 70 is based upon the size, shape and configuration of such impact pad 70. For certain sizes and shapes of impact pad 70, bands alone do not provide sufficient inward force to safely maintain the structural integrity of impact pad 70, such that the pad may be safely maintained and handled in its desired shape.

In another embodiment of the present invention, bricks 72 are bonded together into a pre-formed structure by a bonding composition 94. Bonding composition 94 is preferably comprised of a refractory component and a resin component. The refractory component is preferably comprised of fines of a milled refractory material that is suitable for the specific ladle application, and is compatible with refractory bricks 72. The refractory fines preferably have an average particle size less than 100 Tyler mesh and more preferably, less than 200 Tyler mesh. Similarly, the resin component is preferably comprised of a material that has no deleterious effect on refractory bricks 72 or the molten metal to be handled by ladle 40.

A bonding composition, comprised of about 60–85% of refractory fines and 15–40% of a polymeric resin, finds advantageous application in bonding bricks 72. In one embodiment of the present invention, a bonding composition comprised of about 77% of fused alumina fines and about 22.5% of resol phenolic resin, together with minor amounts of carbon and a mixing aid finds advantageous application in the present invention. Epoxies, urethanes and other types of thermoplastic resins may also be used in forming the bonding composition. Some thermosetting resins may also find advantageous application. As will be appreciated, other combinations of refractory fines and resins may find advantageous application with the present invention. In this respect, any bonding composition having sufficient strength to bond and maintain refractory bricks 72 together as a structural sound component until caste in slab 110 may be used.

In a still further embodiment of the present invention, bricks 72 are maintained together by both a bonding composition as heretofore described, and metallic bands extending around refractory brick 72 to form impact pad 70.

Impact pad 70 is embedded within a slab 110 of refractory material 112. Refractory material 112 used to form slab 110 is selected based upon the desired operating characteristics and performance parameters of bottom lining 60. Various high-temperature refractory castables may find advantageous application in the present invention. In one embodiment of the present invention, a low-moisture, high alumina castable, manufactured and sold by North American Refractories Co. under the trade designation "D-cast 85TM" is used.

One method of forming a bottom lining 60 according to the present invention is to assemble an impact pad 70 within ladle 40 and then cast slab 110 in place around impact pad 70 in ladle 40.

Another method of forming a bottom lining 60 is to place a pre-formed impact pad 70 within ladle 40 and cast slab 110 in place within ladle 40.

According to another method of forming bottom lining 60, impact pad 70 is cast in a mold, and after curing and setting, is removed from the mold and placed within ladle 40 as a pre-assembled unitary component.

Figure 4:
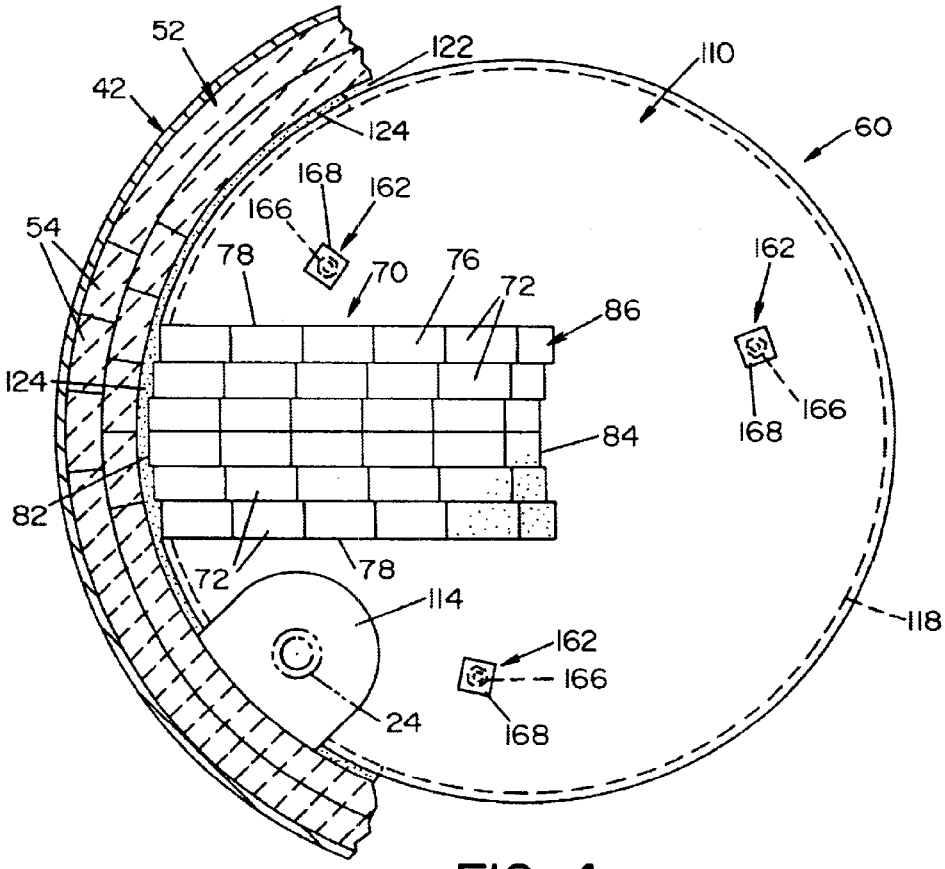
FIG. 4 is a sectional view taken along lines 4—4 of FIG. 3 showing the bottom of the lining shown in FIG. 2.

Bottom lining 60 is dimensioned to "plug" the opening in the bottom of ladle 40 defined by side wall 46, as shown in FIGS. 2–4. As shown in FIG. 3, lining 52 of refractory bricks 54 extends from the open end of ladle 40 to the bottom thereof. This leaves an opening defined by the inner surfaces of lining 52. Bottom lining 60 is dimensioned to essentially fill such an opening.

Slab 110 is essentially circular in shape, and is dimensioned to match the circular opening in the bottom of ladle 40. (As indicated above, ladle 40 may have an oval shape in which case bottom lining 60 would have an oval configuration to conform with the same).

Slab 110 encases impact pad 70 such that upper surface 74 of impact pad 70 is exposed in the upper surface of slab 110. Slab 110 is formed to have a recess 114, best seen in FIGS. 4 and 5, formed therein. Recess 114 is dimensioned to receive, in close mating fashion, nozzle block 22 (not shown in FIG. 2).

Impact pad 70 is preferably attached to slab 110. In the embodiment shown in FIGS. 2–5, V-shaped clips 116 are welded onto metal banding 92. V-shaped clips are disposed between the upper and lower surfaces of impact pad 70 such that V-shaped clips 116 are embedded within slab 10.

Figure 5:
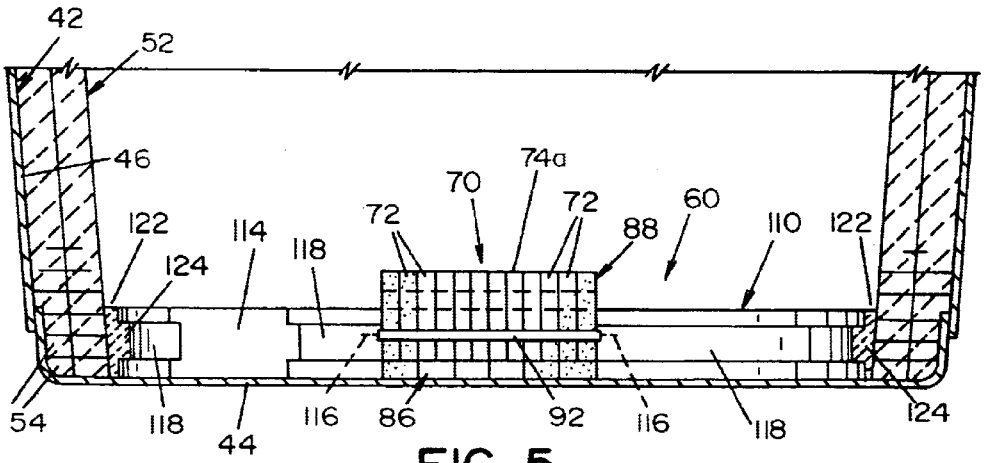
FIG. 5 is a sectional view taken along lines 5—5 of FIG. 3, showing one end of the lining shown in FIG. 2.
Figure 6:
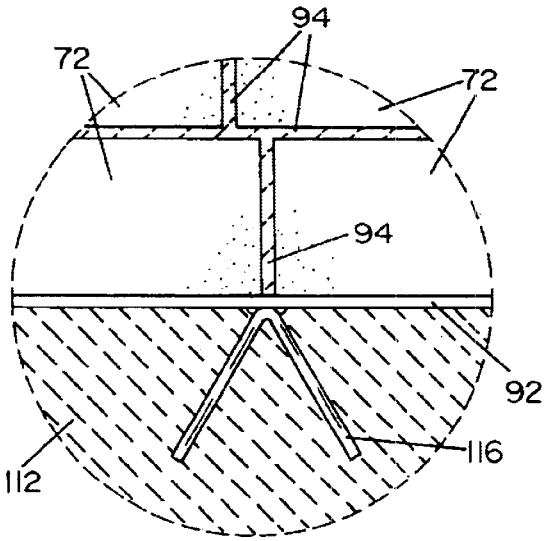
FIG. 6 is an enlarged view of the area identified in FIG. 2.

A U-shaped slot 118, best seen in FIGS. 3 and 5, is formed in the peripheral edge of slab 110 to secure bottom lining 60 in ladle 40. In this respect, in the plug-type bottom lining 60, shown in FIGS. 2–4, bottom lining 60 is dimensioned to form a slight gap 122 between lining 52 of ladle 40 and the peripheral edge of bottom lining 60, as best seen in FIG. 3. Following insertion of bottom lining 60 into ladle 40, gap 122 is filled with a conventionally known, refractory ramming material 124 to complete the refractory lining covering bottom 44 of ladle 40.

Figure 9:
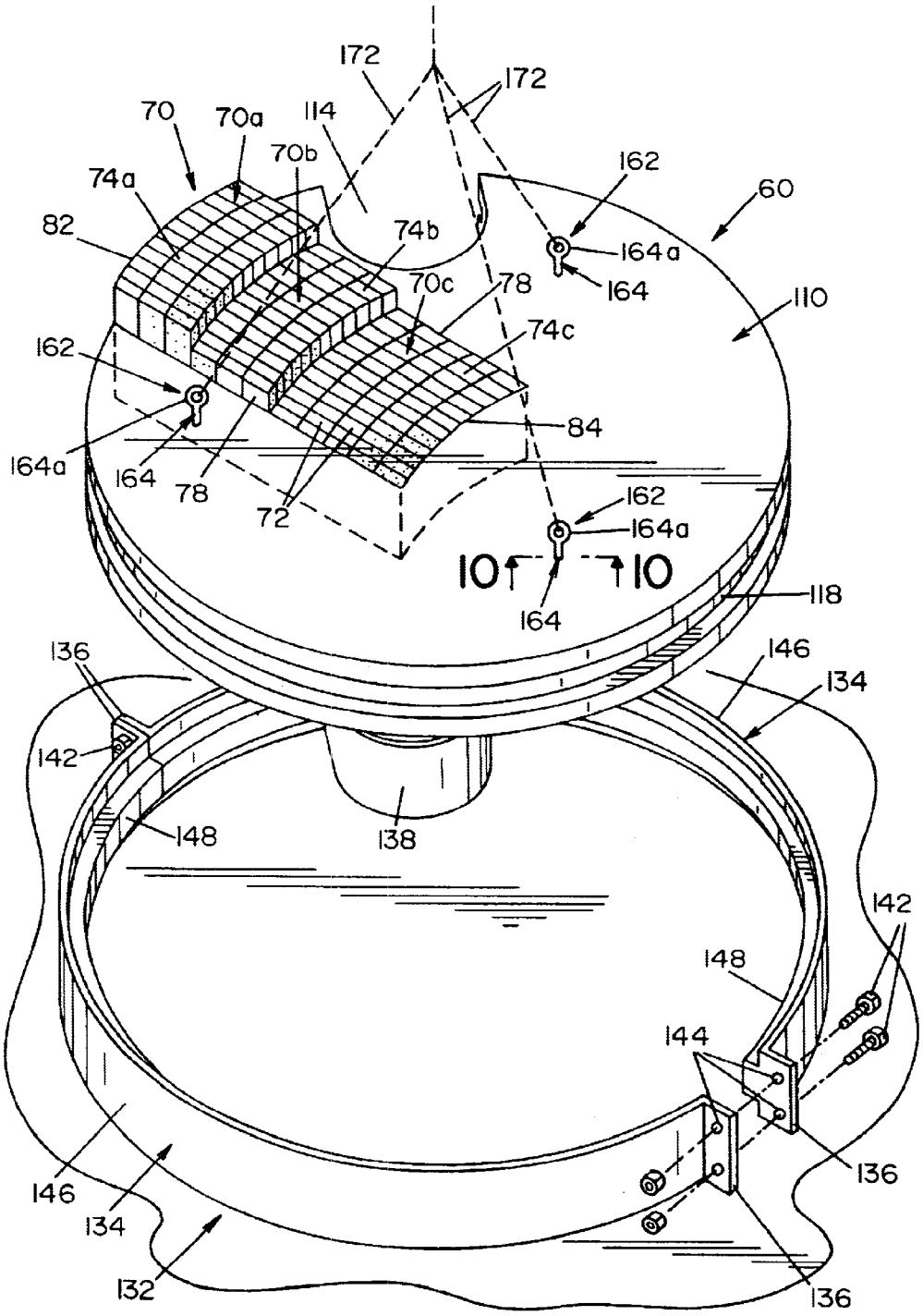
FIG. 9 is a perspective, exploded view showing a lining as shown in FIG. 2 removed from a mold that is used to form the same.
Figure 11:
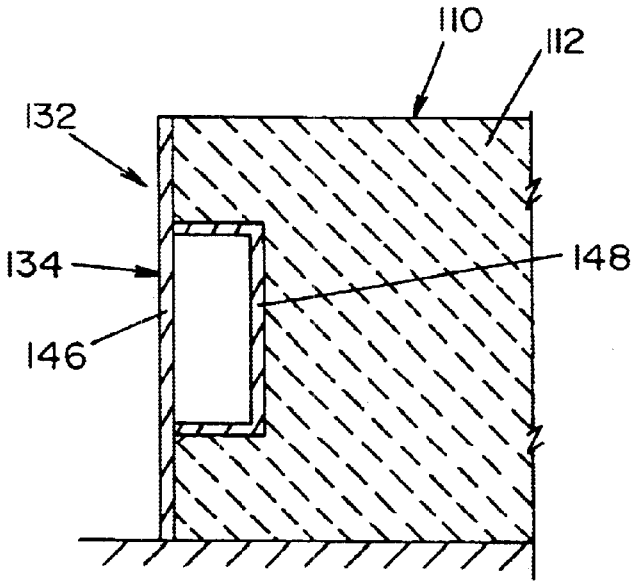
FIG. 11 is a sectional view showing a wall section of the mold that is used to form a pre-determined shape in the lining.
Figure 12:
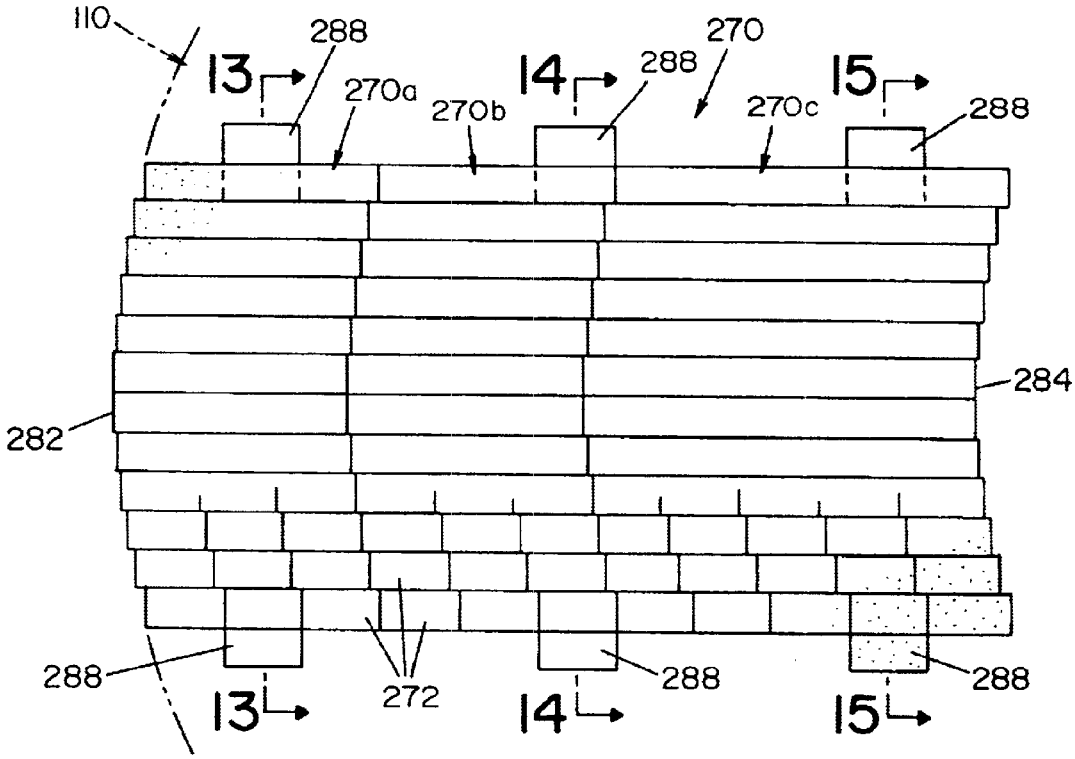
FIG. 12 is a top, plan view of an impact pad, illustrating another embodiment of the present invention.

The present invention shall now be described with respect to a method of forming a pre-assembled, unitary bottom lining 60. FIG. 9 shows a mold 132 for forming a cylindrical bottom lining 60. An oval bottom lining 60 may be formed for use in lining an oval ladle may be formed in a similar fashion. Mold 132 is comprised of mating mold segments 134 that are semi-circular in shape. Each end of each mold section 134 includes an outwardly extending flange 136 that is adapted to mate with a flange 136 on the other mold section 134 so as to mate together. Conventional fasteners 142 extend through holes 144 in flanges 136 to join mold segments 134. Each mold section 134 is essentially a metal strip 146, shown in cross-section in FIG. 11, that is bent into a semi-cylindrical shape conforming to the desired shape of bottom lining 60. As best shown in FIG. 11, a channel 148 is attached to the interior surface of metal strip 146, preferably by welding. Channel 148 is dimensioned to form recess 114 in slab 110. Mold 132 includes a portion 138 that defines recess 114 to receive nozzle block 22. Mold 132 is set upon a flat surface, and impact pad 70 is dispose within mold 132 at a predetermined position relative to mold portion 138. As indicated above, impact pad 70 may be a pre-formed component, or may be assembled in situ within mold 132.

A refractory castable material is then prepared and poured into mold 132 to fill the same. The height of mold 132 basically establishes the thickness of slab 110. In the embodiment shown, slab 110 has a thickness wherein surface 70*c* of impact pad 70 is at the same level as the surface of slab 110, as shown in the drawings. The poured refractory material is allowed to set and cure to produce a monolithic slab 110 with impact pad 70 embedded therein. When the refractory material is hardened, mold segments 134 may be unbolted and removed to expose bottom lining 60.

Figure 7:
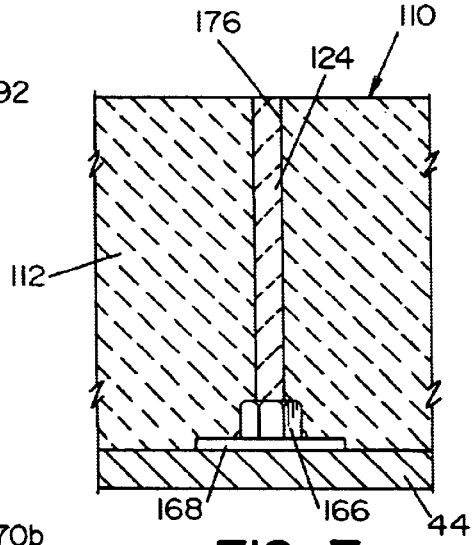
FIG. 7 is a sectional view taken along lines 7—7 of FIG. 2.
Figure 10:
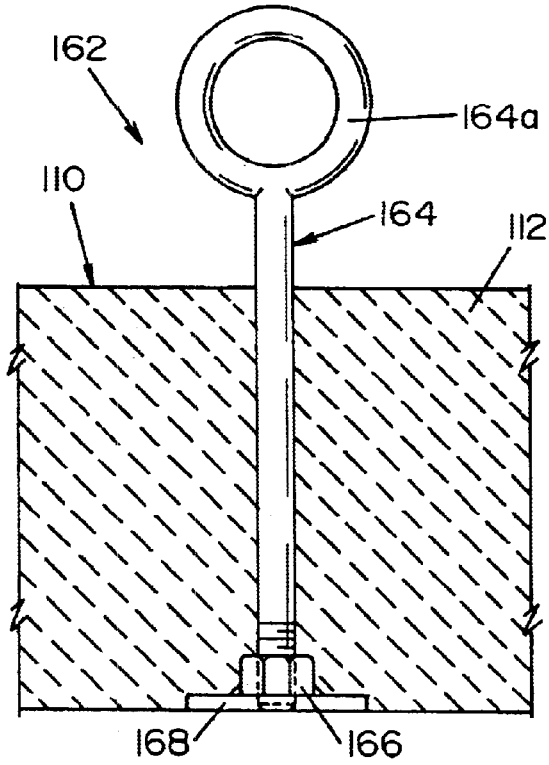
FIG. 10 is a sectional view taken along lines 10—10 of FIG. 9.

To facilitate handling and movement of a pre-formed bottom lining 60, spaced-apart lifting pin assemblies 162 may be embedded within slab 110 during the forming process. Each lifting pin assembly 162 is basically comprised of an eye bolt 164 that is threaded into a matching nut 166 that in turn is then welded to a flat, metallic plate 168. In this respect, several lifting pin assemblies 162 may be set into mold 132 at spaced-apart locations prior to the pouring of the refractory material. Lifting pin assemblies 162 become embedded within slab 110, as best seen in FIG. 10. The eye portion 164*a* of eye bolt 164 projects above the upper surface of slab 110, and may be used to lift bottom lining 60 by means of chains 172 and a lifting device, such as an overhead crane (not shown), as schematically illustrated in FIG. 9. Lifting pin assemblies 162 facilitate movement of a pre-formed bottom lining 60 from its point of fabrication to its ultimate location within ladle 40. Once bottom lining 60 is positioned within ladle 40, eye bolt 164 is unthreaded from nut 166 of lifting pin assemblies 162. Eye bolt 164 is essentially "unscrewed" from slab 110. Removal of an eye bolt 164 leaves a hole 176 in slab 110 that may be filled with conventional, refractory ramming material 124, as illustrated in FIG. 7.

The present invention thus provides a bottom lining 60 for a metallurgical vessel comprised of an impact pad 70 embedded within a monolithic slab 110 of refractory material 112. Such a structure provides the wear resistance of high-density, high-temperature refractory bricks 72 and the more cost-efficient use of a castable refractory material. The present invention may be formed in situ within a metallurgical vessel, or preformed at an offsite location and inserted into a metallurgical vessel. The latter option facilitating more rapid turnaround time and repair of a metallurgical vessel affording less down time.

With either embodiment of the present invention, a pre-formed impact pad 70 is preferred because of its more rapid fabrication. Depending upon the size and configuration of an impact pad, such pad may be formed by banding refractory bricks, or by utilizing a bonding composition, as heretofore described.

Figure 13:
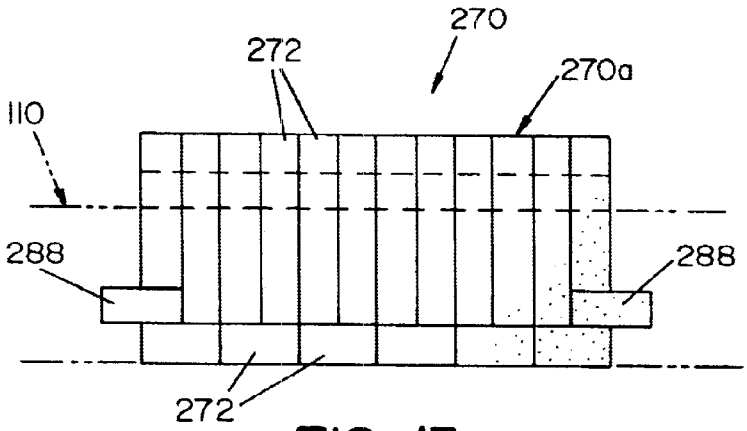
FIG. 13 is an end view taken along lines 13—13 of FIG. 12.
Figure 14:
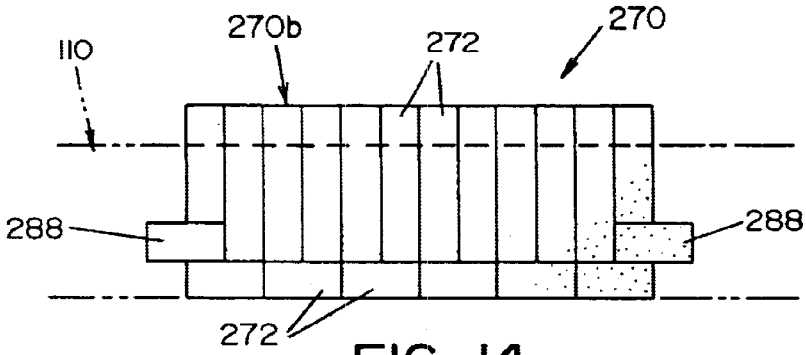
FIG. 14 is a sectional view taken along lines 14—14 of FIG. 12.
Figure 15:
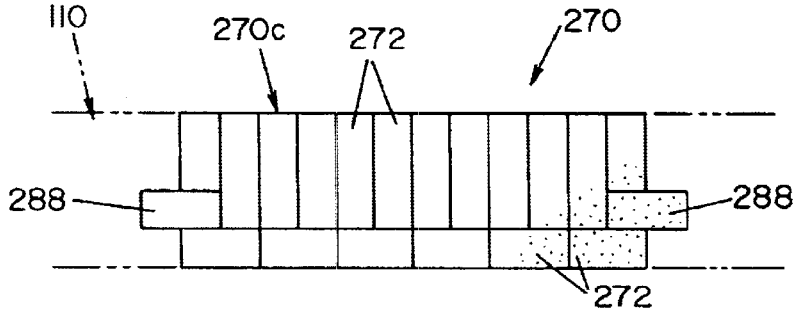
FIG. 15 is a sectional view taken along lines 15—15 of FIG. 12.

Referring now to FIGS. 12–15, an impact pad 270, illustrating an alternate embodiment of the present invention is shown. Impact pad 270 is similar to impact pad 70, as heretofore described. Impact pad 270 is formed of high-temperature, high-density refractory brick 272, and has three sections 270*a*, 270*b*, 270*c*, that form a stepped configuration. Like impact pad 70, impact pad 270 has a first end 282 with a generally convex shape and a second end 284 having a concave shape. Each pad section 270*a*, 270*b* and 270*c* has a tab or finger 288 extending from each side thereof. As best seen in FIGS. 13–15, refractory bricks 272 are arranged such that each section includes a laterally extending brick 272 forming tabs 288. Tabs 288 essentially form locking pins that are embedded within monolithic slab 110 to form a securing arrangement similar to that created by V-shaped clips 116 on impact pad 70. Impact pad 270 is preferably joined by a bonding composition as heretofore described, although banding may also be used. Once embedded within monolithic slab 110, tabs 288 assist in locking impact pad 270 within slab 110.

Figure 16:
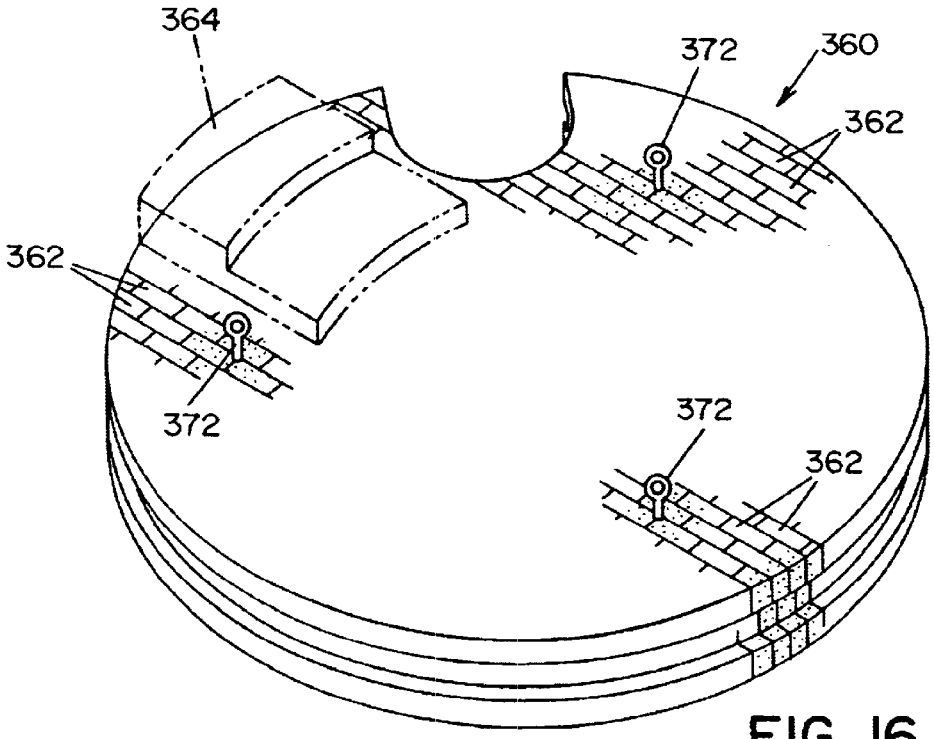
FIG. 16 is a perspective view of a lining for the bottom of a metallurgical vessel, illustrating yet another embodiment of the present invention.

Referring now to FIG. 16, a bottom lining 360 illustrating another embodiment of the present invention is shown. It has been found that a bonding composition as heretofore described, may be used to form an entire bottom lining 360 from refractory brick 362. Although forming an entire bottom lining 360 from refractory brick 362 is both time-consuming and more costly than bottom lining 60, as heretofore described, in some applications, it may be desirable to have a pre-formed bottom lining 360 formed entirely of refractory bricks 362 replacement brick pad ready for a steel ladle or a metallurgical vessel for quick replacement. As illustrated in phantom in FIG. 16, a stepped impact area 364 may be formed in bottom lining 360. As with the previous embodiment, lifting pins 372 may be provided in the seams formed between adjacent bricks 372 to facilitate movement and transportation of such bottom lining 360.

In the foregoing description, specific embodiments of the present invention were described. It should be appreciated that these embodiments are described for purposes of illustration only, and that numerous alterations and modifications may be practiced by those skilled in the art without departing from the spirit and scope of the invention. It is intended that all such modifications and alterations be included insofar as they come within the scope of the invention as claimed or the equivalents thereof.

Having described the invention, the following is claimed:

1. A lining for a bottom of a metallurgical vessel, comprising:

an impact pad comprised of a plurality of close-packed, pre-formed, high-temperature, high-density refractory bricks, wherein said bricks are joined together by a metallic band, said pad having an upper impact surface; and a monolithic slab of a high-temperature cast refractory material encasing said pad, said slab encasing said pad wherein said upper surface of said impact pad is exposed.

2. A lining as defined in claim 1, wherein said metallic band extends around the periphery of said impact pad and is embedded within said slab.

3. A lining in a metallurgical vessel for receiving and dispensing a molten metal, comprised of:

an impact pad comprised of a plurality of close-packed, pre-formed refractory brick wherein said plurality of refractory brick is bonded together by a mechanical fastener, said pad having an upper impact surface; and a monolithic slab of a high-temperature, cast refractory material encasing said pad, said slab encasing said pad wherein said upper surface of said impact pad is exposed.

4. In a metallurgical vessel for receiving and dispensing a molten metal, a refractory component comprised of:

an impact pad comprised of a plurality of close-packed, pre-formed refractory brick, said pad having an upper impact surface; and a monolithic slab of a high-temperature, cast refractory material encasing said pad, said slab dimensioned to form a refractory lining over the bottom of a metallurgical vessel and said lining including lifting elements formed in said lining for facilitating movement of said lining.

5. A pre-formed impact pad comprised of:

a plurality of high-density, high-temperature refractory bricks bonded together into a predetermined shape by a bonding composition, said bonding composition comprised of about 60% to 85% by weight of refractory fines having a particle size of less than 100 Tyler mesh (150 $\mu$m), and about 15% to 40% by weight of a polymeric resin; and a plurality of projections extending outwardly from the sides thereof, wherein said projections are metal clips attached to said impact pad.

6. A pre-formed impact pad as defined in claim 5, further comprising a metallic band extending around said pad.

* * * * *